US007158084B2

(12) United States Patent
Kim et al.

(10) Patent No.: US 7,158,084 B2
(45) Date of Patent: Jan. 2, 2007

(54) VARIABLE ANTENNA APPARATUS FOR A MOBILE TERMINAL

(75) Inventors: Dong-Hwan Kim, Hwaseong-si (KR); Byung-Duck Cho, Seoul (KR); Wan-Jin Choi, Suwon-si (KR)

(73) Assignee: Samsung Electronics Co., Ltd. (KR)

( * ) Notice: Subject to any disclaimer, the term of this patent is extended or adjusted under 35 U.S.C. 154(b) by 25 days.

(21) Appl. No.: 10/946,819

(22) Filed: Sep. 22, 2004

(65) Prior Publication Data

US 2005/0237242 A1 Oct. 27, 2005

(30) Foreign Application Priority Data

Apr. 22, 2004 (KR) ..... 10-2004-0027728

(51) Int. Cl.
*H01Q 1/24* (2006.01)

(52) U.S. Cl. ..... 343/702; 343/714; 343/736; 343/869; 343/881

(58) Field of Classification Search ..... 343/702, 343/829

See application file for complete search history.

(56) References Cited

U.S. PATENT DOCUMENTS 5,929,814 A * 7/1999 Grossman et al. ..... 343/702
5,969,685 A * 10/1999 Hayes et al. ..... 343/702
6,043,781 A * 3/2000 Toh et al. ..... 343/702
6,075,500 A * 6/2000 Kurz et al. ..... 343/895
6,232,924 B1 * 5/2001 Winstead et al. ..... 343/702
6,272,356 B1 * 8/2001 Dolman et al. ..... 455/575.3
2002/0000941 A1 * 1/2002 Johnson ..... 343/702
2005/0001771 A1 * 1/2005 Tanaka et al. ..... 343/702

FOREIGN PATENT DOCUMENTS

| | | |
|---|---|---|
| EP | 1 263 083 | 4/2002 |
| WO | WO 97/18600 | 5/1997 |
| WO | WO 99/39258 | 8/1999 |
| WO | WO 02/31912 | 4/2002 |

* cited by examiner

*Primary Examiner*—Don Wong
*Assistant Examiner*—Binh Van Ho
(74) *Attorney, Agent, or Firm*—The Farrell Law Firm

(57) ABSTRACT

A variable antenna apparatus for a mobile terminal. The variable antenna apparatus includes a radiation component that is rotatably coupled with the mobile terminal, a feeding component that is adjacent to a first end part of the radiation component and electrically connected to a radio frequency board of the mobile terminal. A grounding component is adjacent to the first end part of the radiation component and selectively connected to a ground of the radio frequency board as the radiation component is rotated. The antenna apparatus is accommodated in a terminal so that it is possible to conveniently carry the terminal, and the antenna is rotatably protruded from the terminal during a telephone call, such that appropriate antenna gain is achieved.

14 Claims, 5 Drawing Sheets

VARIABLE ANTENNA APPARATUS FOR A MOBILE TERMINAL

PRIORITY

This application claims priority to an application entitled "Variable Antenna Apparatus for Mobile Terminal" filed in the Korean Intellectual Property Office on Apr. 22, 2004 and assigned Serial No. 2004-27728, the contents of which are hereby incorporated by reference.

BACKGROUND OF THE INVENTION

1. Field of the Invention

The present invention relates generally to a mobile terminal, and more particularly to an antenna apparatus of a mobile terminal.

2. Description of the Related Art

Conventionally, the term "mobile terminal" refers to mobile electronic device capable of communication. Such mobile terminals have a current tendency to be lightweight and compact in size. Also, mobile terminals provide many functions, such as multimedia and Internet services.

Additionally, mobile terminals are being produced with various and distinguished designs, such as rotary-type terminals capable of inversely rotating a housing equipped with a display device between front and rear sides of the housing, and slide-type terminals having a pair of housings coupled with each other in such a manner that the housings can slidably move in a length direction thereof, which are advanced from the even more conventional bar-type terminals, flip-type terminals, and folder-type terminals.

Mobile terminals commonly have an antenna apparatus for ensuring sufficient transmitting/receiving rates and signal quality. In general, an antenna apparatus includes a combination of a helical antenna fixed on a terminal body and a whip antenna installed on a terminal body in such a manner that the whip antenna is introduced into/drawn out of the terminal body. However, as performance of an antenna apparatus has become improved, it is possible to utilize a single antenna apparatus fixed to a terminal body. An antenna apparatus accommodated in a terminal body has been also commercialized.

FIG. 1 illustrates a conventional mobile terminal 10 having an antenna apparatus 19. As illustrated in FIG. 1, the mobile terminal 10 is a folder-type terminal including a body 11 and a folder 12, which is rotatably coupled with the body 11. Although not illustrated, a keypad and a signal transmitting component are installed in the body 11, and a main display unit and a signal receiving part are installed on the folder 12.

A small display unit 17 is installed at an outer peripheral surface of the folder 12, such that information about the mobile terminal 10, e.g., battery power, a signal strength, the date and time, etc., is displayed. A pair of side hinge arms 13 are formed at both upper side portions of the body 11, and a center hinge arm 15 is formed at one end of the folder 12. The center hinge arm 15 is rotatably coupled between the side hinge arms 13, such that the folder 12 is rotatably connected to the body 11.

The antenna apparatus 19 of the terminal 10 is installed on an upper end of the body 11 and protrudes therefrom. The antenna apparatus 19 includes a combination of a helical antenna fixed on the body 11 and a whip antenna installed on the body 11 in such a manner that the whip antenna is introduced into/drawn out of the body 11. A structure of such an antenna apparatus is generally known to those skilled in the art.

However, an antenna apparatus protruding out of a terminal, such as antenna apparatus 19, restricts a design of the mobile terminals and may make it difficult to carry the terminal. Further, because the antenna apparatus is exposed to the outside, it may be easily damaged when any external impact is applied thereto or when the mobile terminal is dropped.

Accordingly, to solve the above-described problems, an internal antenna can be installed in a mobile terminal. However, an antenna gain of the internal antenna may be reduced due to electromagnetic interference between the internal antenna and circuit devices, such as a radio frequency (RF) board of the terminal, and due to interference from a structure, such as a terminal housing. Consequently, it is difficult to ensure good quality of service (QoS) of the mobile terminal.

SUMMARY OF THE INVENTION

Accordingly, the present invention has been designed to solve the above and other problems occurring in the prior art, and a first object of the present invention is to provide a variable antenna apparatus for a mobile terminal, which enables various terminal designs to more conveniently carry the mobile terminal.

A second object of the present invention is to provide a variable antenna apparatus for a mobile terminal, which prevents an antenna from being broken when an external impact applied thereto.

A third object of the present invention is to provide a variable antenna apparatus for a mobile terminal, which ensures good QoS by preventing an antenna gain from being lowered as a result of electromagnetic interference between an internal antenna and circuit devices and interference from a structure.

In order to accomplish the above and other objects, there is provided a variable antenna apparatus for a mobile terminal. The variable antenna apparatus includes a radiation component that is rotatably coupled with the mobile terminal, a feeding component, which is adjacent to a first end part of the radiation component and electrically connected to a radio frequency board of the mobile terminal, and a grounding component that is adjacent to the first end part of the radiation component and selectively connected to a ground of the radio frequency board as the radiation component is rotated.

BRIEF DESCRIPTION OF THE DRAWINGS

The above and other objects, features, and advantages of the present invention will be more apparent from the following detailed description taken in conjunction with the accompanying drawings, in which.

DETAILED DESCRIPTION OF THE PREFERRED EMBODIMENT

Figure 1:
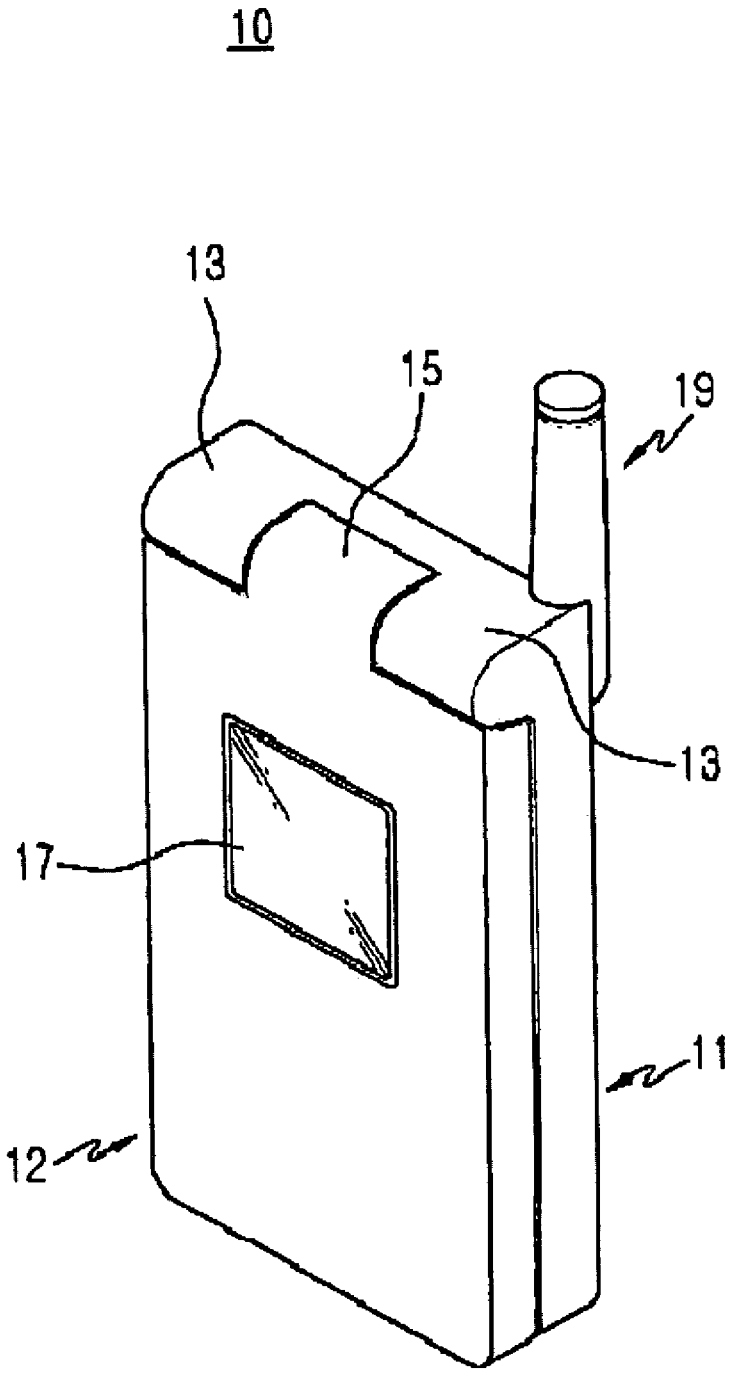
FIG. 1 (PRIOR ART)
FIG. 1 illustrates a conventional mobile terminal including an antenna apparatus.

Preferred embodiments of the present invention will be described in detail herein below with reference to the accompanying drawings. In the accompanying drawings, the same or similar components are designated by the same reference numerals although they are shown in different drawings. Additionally, in the following description of the present invention, a detailed description of known functions and configurations incorporated herein will be omitted when it may obscure the subject matter of the present invention.

Figure 2:
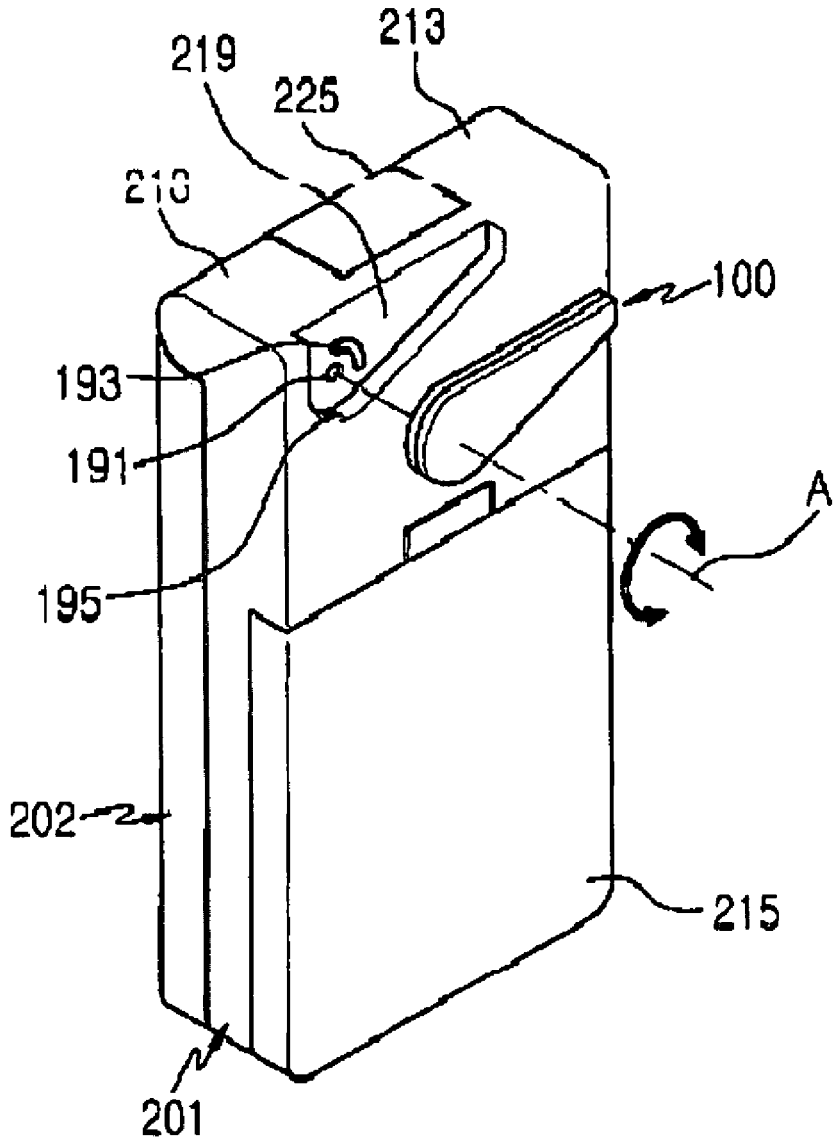
FIG. 2 illustrates a mobile terminal including a variable antenna apparatus according to a preferred embodiment of the present invention.

FIG. 2 illustrates a mobile terminal 200 including a variable antenna apparatus 100 according to a preferred embodiment of the present invention. As illustrated in FIG. 2, the mobile terminal 200 is a folder-type terminal including a body 201 and a folder 202 rotatably coupled with the body 201. A battery 215 is provided at a rear side of the body 201. Although not illustrated, a keypad and a signal transmitting part are installed on the body 201, and a main display unit and a signal receiving part are installed on the folder 202.

A pair of side hinge arms 213 are formed at both upper side portions of a front side of the body 201, and a center hinge arm 225 is formed at one end of the folder 202. The center hinge arm 225 is rotatably coupled between the side hinge arms 213, such that the folder 202 is rotatably connected to the body 201.

The antenna apparatus 100 is rotatably accommodated into a receiving groove 219, which is formed in the rear side of the body 201. Accordingly, the antenna apparatus 100 may be accommodated in the receiving groove 219 or rotated to protrude out of the terminal 200.

Figure 3:
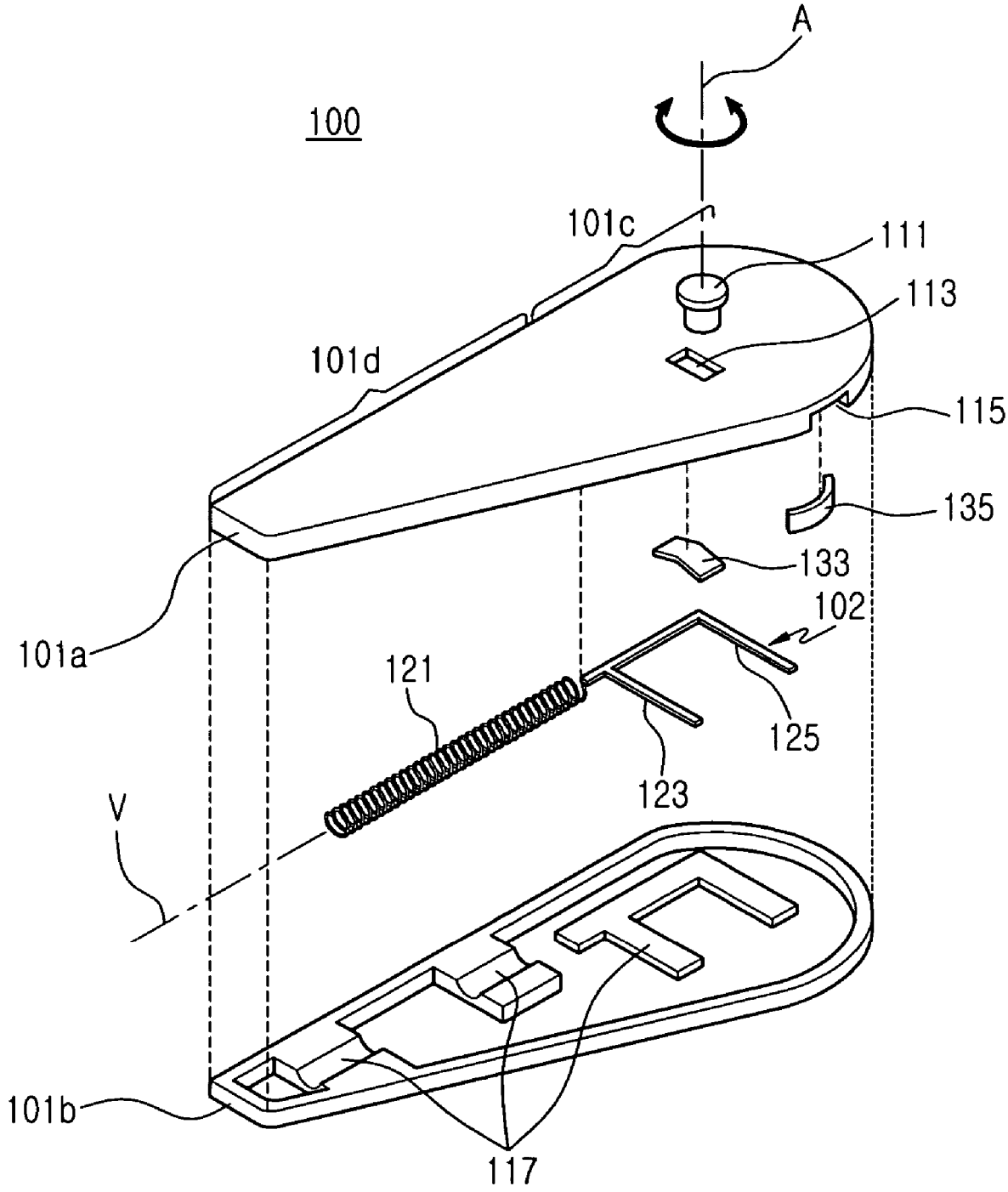
FIG. 3 is an exploded perspective view of the antenna apparatus illustrated in FIG. 2.
Figure 4:
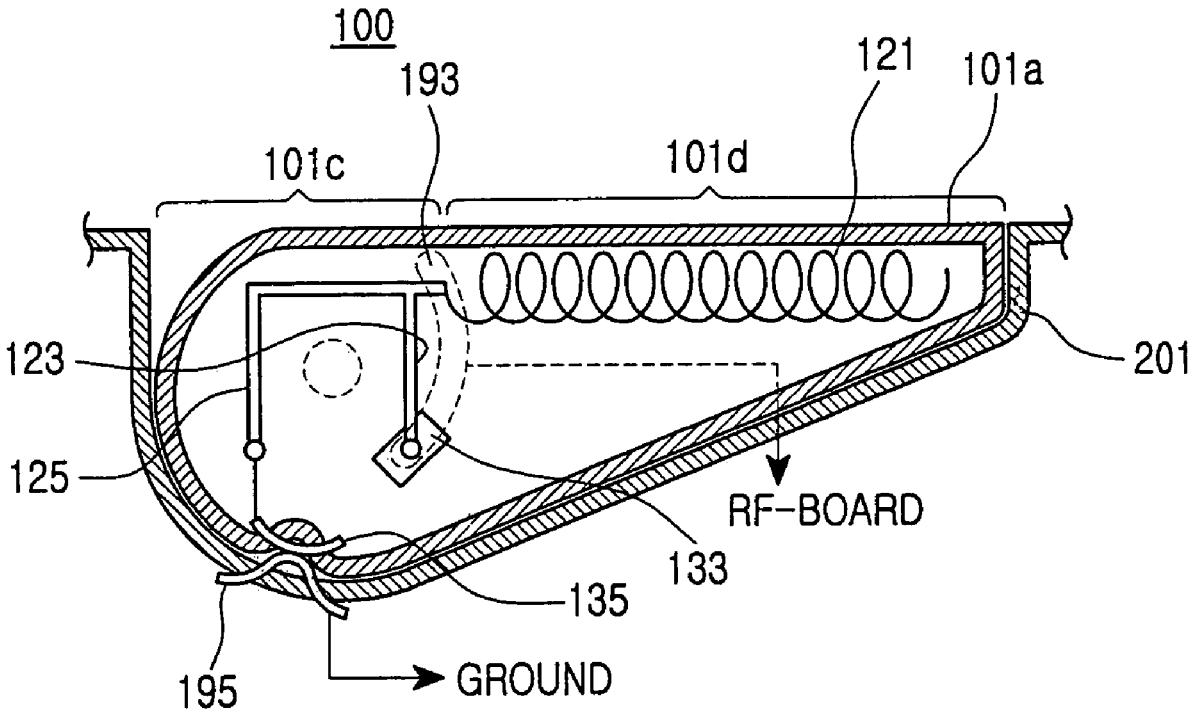
FIG. 4 is a sectional view of the antenna apparatus illustrated in FIG. 2.

Referring to FIGS. 3 and 4, the antenna apparatus 100 includes antenna housings 101*a* and 101*b*, and an antenna 102, which is accommodated within the antenna housings 101*a* and 101*b*. The antenna housings 101*a* and 101*b* include a rotary housing section 101*c* rotatably accommodated in the receiving groove 219 of the terminal body 201, and a receiving housing section 101*d* integrally formed with the rotary housing section 101*c* and extending from an outer peripheral surface of the rotary housing section 101*c*.

As the rotary housing section 101*c* is rotated in the receiving groove 219, the receiving housing section 101*d* may be accommodated in the receiving groove 219 or may be protruded from the terminal 200. The antenna housings 101*a* and 101*b* include a rotary protrusion 111 formed on one side of the rotary housing section 101*c* in such a manner that the rotary protrusion 111 is rotatably inserted into a rotation hole 191 formed in the receiving groove 219. As the rotary protrusion 111 is inserted into the rotation hole 191, a rotation axis A that extends in a vertical direction to one side of the rotary housing section 101*c* is formed. At least one support member 117 for supporting the antenna 102 is formed within the antenna housings 101*a* and 101*b*. Accordingly, the support member 117 has a shape corresponding to a shape of the antenna 102.

The antenna 102 includes a radiation component 121 accommodated in the receiving housing section 101*d* and a feeding component 123 and a grounding component 125, which both extend from an end part of the radiation component 121 and are accommodated in the rotary housing section 101*c*. The radiation component 121 has a shape of a helical antenna wound around a virtual axis V. The feeding component 123 and the grounding component 125 are spaced from each other by a predetermined distance and extend in parallel to each other at the end part of the radiation component 121. Also, the feeding component 123 and the grounding component 125 extend perpendicularly from the virtual axis.

The antenna apparatus 100 includes connection terminals for electrically connecting the feeding component 123 and the grounding component 125 of the antenna 102 to a circuit part of the terminal 200. Preferably, the circuit part of the terminal 200 is a radio frequency (RF) board (not shown).

A first connection terminal for electrically connecting the feeding component 123 of the antenna 102 to the RF board includes a feeding hole 113, which is preferably formed at one side of the antenna housings 101*a* and 101*b*, a feeding terminal 133, which is installed in an internal side of the antenna housings 101*a* and 101*b* and protrudes through the feeding hole 113, and a feeding pad 193, which is installed in the receiving groove 219.

The feeding terminal 133, which is electrically connected to the feeding component 123 of the antenna 102, protrudes from one side of the antenna housings 101*a* and 101*b*, and makes sliding-contact with the receiving groove 219, that is, the feeding pad 193. The feeding pad 193 is electrically connected to the RF board of the terminal 200 and is installed correspondingly to a trace of the feeding terminal 133, in which the trace is formed along a path, which the feeding terminal 133 passes through as the antenna housings 101*a* and 101*b* are rotated.

As a result, the feeding component 123 is connected to the RF board of the terminal 200 by means of the feeding terminal 133 and the feeding pad 193. The feeding component 123 always maintains electrical connection with the RF board regardless of a rotation of the antenna housings 101*a* and 101*b*.

A second connection terminal for electrically connecting the grounding component 125 of the antenna 102 to the RF board includes a grounding hole 115, which is formed at an outer peripheral surface of the antenna housings 101*a* and 101*b*, a grounding terminal 135, which is installed in an internal side of the antenna housings 101*a* and 101*b* and exposed to the exterior through the grounding hole 115, and a leaf spring 195, which is installed on a sidewall of the receiving groove 219.

The grounding hole 115 is formed at an outer peripheral surface of the antenna housings 101*a* and 101*b*. More specifically, the grounding hole 115 is preferably formed at an outer peripheral surface of the rotary housing section 101*c*. Additionally, the grounding terminal 135 is electrically connected to the grounding component 125 of the antenna 102 and is installed in the grounding hole 115. The leaf spring 195 is installed on the sidewall of the receiving groove 219 and is electrically connected to a ground of the RF board.

Therefore, when the antenna housings 101*a* and 101*b* are positioned at the receiving groove 219, the leaf spring 195 is installed in such a manner that the leaf spring 195 faces the grounding hole 115. Accordingly, if the antenna housings 101*a* and 101*b* are positioned at the receiving groove 219, the leaf spring 195 makes contact with the grounding terminal 135 in such a manner that the leaf spring 195 electrically connects the grounding component 125 to the ground of the RF board. Also, the leaf spring 195 is engaged with the grounding hole 115 in order to prevent the antenna housings 101*a* and 101*b* from moving. If the antenna housings 101 *a* and 101*b* are rotated and moved out of the receiving groove 219, the grounding terminal 135 and the leaf spring 195 are disconnected.

When the antenna housings 101*a* and 101*b* are positioned at the receiving groove 219, the feeding component 123 is connected to the RF board, and the grounding component 125 is connected to the ground of the RF board, such that the antenna 102 operates as an inverted F type antenna in the same manner as a general internal antenna. If the antenna housings 101*a* and the 101*b* are rotated and the receiving housing section 101*d* is moved out of the receiving groove 219, the grounding component 125 and the ground are disconnected and only the feeding component 123 is electrically connected to the RF board. At the same time, the radiation component 121 protrudes from the terminal, such that the antenna 102 is operated as a general monopole antenna.

Accordingly, when carrying the mobile terminal, the antenna apparatus 100 is operated as an internal antenna and a user can conveniently carry the mobile terminal. Also, when transmitting data or speaking over the telephone, the radiation component 121 of the antenna 102 is rotated and protrudes from the terminal, such that electromagnetic or mechanical interference is prevented. As a result, antenna gain is improved.

Figure 5:
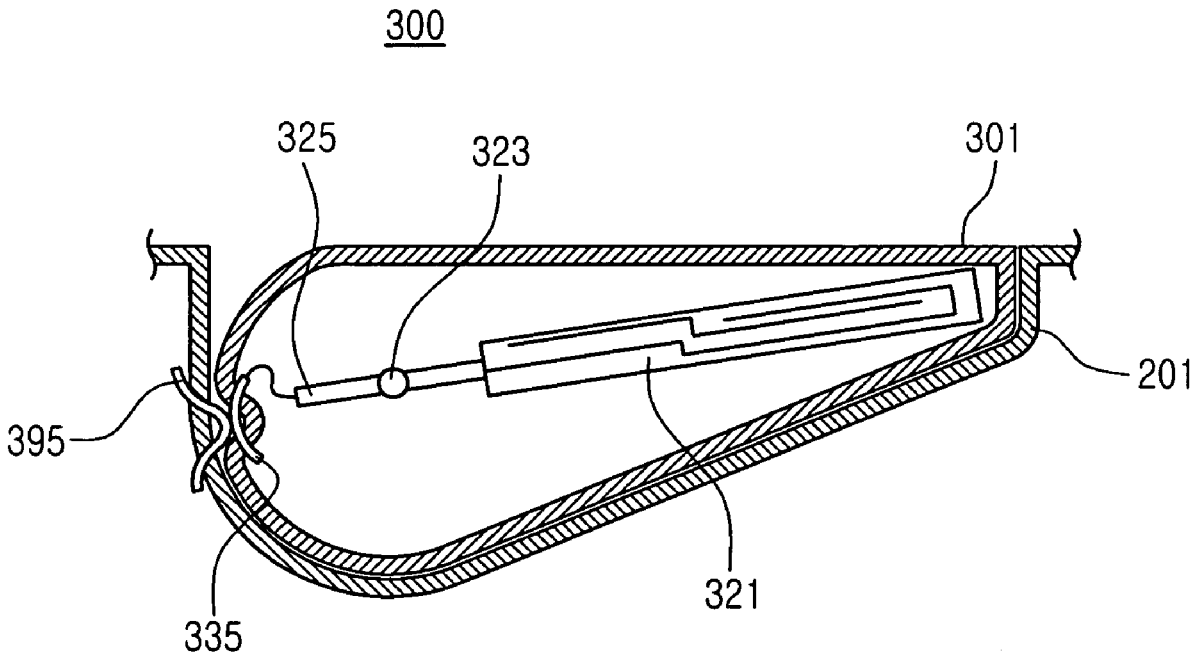
FIG. 5 illustrates an antenna apparatus according to another preferred embodiment of the present invention.

FIG. 5 illustrates an antenna apparatus 300 according to another preferred embodiment of the present invention. In the following description with reference to FIG. 5, components identical or similar to components of the first preferred embodiment will be omitted or given with the same reference numerals.

Referring to FIG. 5, the antenna apparatus 300 according to another preferred embodiment of the present invention includes an antenna housing 301, a microstrip antenna 321, which extends in one direction within the antenna housing 301, a feeding point 323, which is provided at a predetermined position of an end part of the microstrip antenna 321, and a grounding point 325, which spaced from the feeding point 323 by a predetermined distance. Preferably, the feeding point 323 is positioned on a rotation axis in the antenna housing 301. Also, the feeding point 323 can be electrically connected to the RF board using the rotary protrusion (not shown) of the antenna housing 301. Further, when the feeding point 323 is electrically connected to the RF board, the connection terminal described in the first embodiment may be included.

The grounding point 325 is electrically connected to a grounding terminal 335, which is exposed to an outer peripheral surface of the antenna housing 301, and a leaf spring 395, which is connected to the ground of the RF board, is installed on the terminal body 201. The antenna housing 301 is accommodated in the receiving groove (not shown) of the terminal body 201, and the grounding terminal 335 contacts with the leaf spring 395 such that the grounding point 325 is electrically connected to the ground.

Therefore, the antenna apparatus 300 enables a user to accommodate the antenna housing 301 in the terminal or protrude the antenna housing 301 from the terminal, such that the terminal is conveniently used and a good antenna gain can be ensured.

As described above, an antenna apparatus according to the present invention is accommodated in a terminal, such that it is possible to conveniently carry the terminal, and the antenna protrudes from an exterior of the terminal during a telephone call, such that it is possible to ensure an antenna gain. Also, the antenna apparatus is accommodated in the terminal and provides the terminal with feeding and grounding for operating as an inverted F type-antenna, such that it is possible to maintain a good transmitting/receiving state between a terminal and a base station, etc.

Additionally, according to the present invention, because the antenna is stored flush with the body of the mobile terminal, i.e., the antenna does not protrude from the body when retracted, it is possible to prevent an antenna from being broken when external impact is applied to the antenna or when mobile terminal is dropped.

While the present invention has been shown and described with reference to certain preferred embodiments thereof, it will be understood by those skilled in the art that various changes in form and details may be made therein without departing from the spirit and scope of the present invention.

For example, although an inverted F-type antenna is described in the present invention, an inverted L-type antenna, etc., may be employed. Also, although an antenna having a helical antenna shape or a microstrip antenna shape is exemplified when designing a radiation part of an antenna, it is well-known to those skilled in the art that an antenna having a whip antenna shape, a patch antenna shape, etc., can also be employed.

In addition, although it is illustrated that a variable antenna apparatus according to the present invention is coupled to an upper end of a folder-type terminal body, the variable antenna apparatus is also applicable for a bar-type terminal or a flip-type terminal. Further, the variable antenna apparatus can be installed in a lower end or a side end of a terminal rather than an upper end of a terminal. Consequently, the scope of the invention should not be limited to the disclosed embodiments, but should be defined by the appended claims and equivalents thereof.

What is claimed is:

1. A variable antenna apparatus for a mobile terminal, the variable antenna apparatus comprising:

a radiation component, which is rotatably coupled with the mobile terminal;

a feeding component, which is adjacent to a first end part of the radiation part and electrically connected to a radio frequency board of the mobile terminal;

a grounding component, which is adjacent to the first end part of the radiation and selectively connected to a ground of the radio frequency board as the radiation component is rotated; and an antenna housing including a rotary housing that is rotatably coupled with the mobile terminal, and a receiving housing, which is integrally formed with the rotary housing, extends from an outer peripheral surface of the rotary housing, and receives the radiation component, wherein the receiving housing can be accommodated in the mobile terminal and protrudes as the rotary housing is rotated, and the feeding component is positioned at the rotary housing, which includes a feeding hole formed at one side of the rotary housing so as to face an outer peripheral surface of the mobile terminal, a feeding terminal electrically connected to a feeding part, an end of the feeding terminal protrudes through the feeding hole so as to slidably contact an outer peripheral surface of the mobile terminal if the rotary housing is rotated, and a feeding pad electrically connected to the radio frequency board and installed on the mobile terminal along a rotation trace of the feeding terminal, which is formed as the rotary housing is rotated.

2. The variable antenna apparatus of claim 1, wherein the radiation component is accommodated in the mobile terminal and protrudes from the mobile terminal as the radiation component is rotated on the mobile terminal.

3. The variable antenna apparatus of claim 2, wherein the grounding component is connected to the ground of the radio frequency board when the radiation component is accommodated in the mobile terminal, and the grounding component is disconnected from the radio frequency board when the radiation part protrudes from the mobile terminal.

4. The variable antenna apparatus of claim 1, wherein the radiation component, the feeding component, and the grounding component are embodied as an inverted F type antenna having the radiation component installed on a virtual axis, such that an end part of the radiation component is rotatably coupled with the mobile terminal, the feeding component perpendicularly extending from the virtual axis at the first end part of the radiation component, and the grounding component, which is spaced from the feeding component by a predetermined distance, extending from the first end part of the radiation component, in parallel to the feeding component.

5. The variable antenna apparatus of claim 4, wherein the radiation component is a helical antenna wound around the virtual axis.

6. The variable antenna apparatus of claim 4, wherein the radiation component is a microstrip antenna having a predetermined pattern installed along the virtual axis.

7. The variable antenna apparatus of claim 4, wherein the radiation component is a whip antenna extending along the virtual axis.

8. The variable antenna apparatus of claim 4, wherein a feeding point is provided for a second end part of the feeding component extending from the radiation component, and a grounding point is provided for a third end part of the grounding component extending from the radiation part.

9. The variable antenna apparatus of claim 8, wherein a feeding pad is installed on the mobile terminal, the feeding pad having a shape corresponding to a trace of the feeding point, in which the trace is formed along a path, which the feeding terminal passes through as the radiation part is rotated.

10. The variable antenna apparatus of claim 1, wherein the grounding component includes a grounding point provided for a first end part of the radiation component, the feeding component includes a feeding point that is adjacent to the first end part of the radiation component and spaced from the grounding component by a predetermined distance, and the feeding point is positioned on a rotation axis of the radiation component.

11. The variable antenna apparatus of claim 1, wherein the first end part of the radiation component, the feeding component, and the grounding component are positioned at the rotary housing.

12. The variable antenna apparatus of claim 1, further comprising a receiving groove having a shape corresponding to a shape of the antenna housing on an outer peripheral surface of the mobile terminal.

13. The variable antenna apparatus of claim 1, wherein the grounding component is positioned at the rotary housing, which includes a grounding hole formed on a predetermined position of an outer peripheral surface of the rotary housing, a grounding terminal electrically connected to the grounding part and installed in the grounding hole so as to be exposed to an exterior of the rotary housing, and a leaf spring electrically connected to the ground of the radio frequency board, installed in the mobile terminal, and connected to the grounding terminal when the receiving housing is accommodated in the mobile terminal.

14. The variable antenna apparatus of claim 1, further comprising a rotary protrusion that is rotatably coupled with the mobile terminal and protrudes from one side of the rotary housing.

* * * * *